United States Patent [19]

Tisbo et al.

[11] Patent Number: 4,542,938

[45] Date of Patent: Sep. 24, 1985

[54] FLEXIBLE CHAIR

[75] Inventors: Cosmo N. Tisbo; Thomas A. Tisbo, both of Barrington; Richard D. Recker, Palatine; Bruce Heggeland, Rolling Meadows, all of Ill.

[73] Assignee: Suncast Corporation, Batavia, Ill.

[21] Appl. No.: 484,144

[22] Filed: Apr. 11, 1983

[51] Int. Cl.[4] ..... A47C 1/12

[52] U.S. Cl. ..... 297/445; 297/295

[58] Field of Search ..... 297/445, 295, 296, 294, 297/419–421

[56] References Cited

U.S. PATENT DOCUMENTS

| | | | |
|---|---|---|---|
| 3,814,477 | 6/1974 | Mattsson | 297/419 |
| 4,119,286 | 10/1978 | Barril | 297/445 |
| 4,124,251 | 11/1978 | Petersen | 297/445 |

*Primary Examiner*—Kenneth Downey

*Attorney, Agent, or Firm*—Anthony S. Zummer

[57] ABSTRACT

A chair construction having a movable seat and back includes a pair of chair sides. Said chair sides are mirror images of each other. A substantially horizontal seat is positioned between said chair sides, and a substantially vertical back is also positioned between said chair sides. Each of the chair sides is formed of a single piece of continuous elongated flexible tubular plastic material. Each chair side includes a back upright. Each back upright has a horizontal floor rail formed integral with the lower end thereof. Each horizontal floor rail has a front upright formed integral therewith. Each front upright has an arm portion formed integral with the upper end thereof. Each arm portion is fixed to its respective back upright.

11 Claims, 7 Drawing Figures

FIG. 1
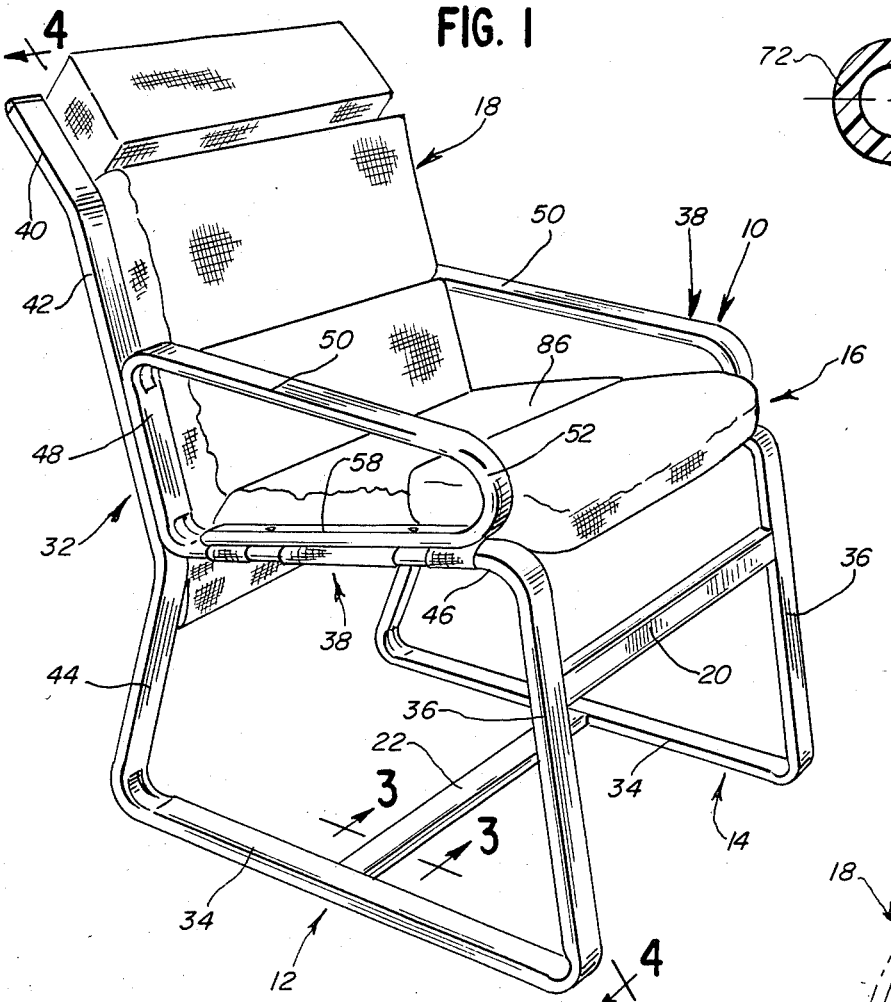
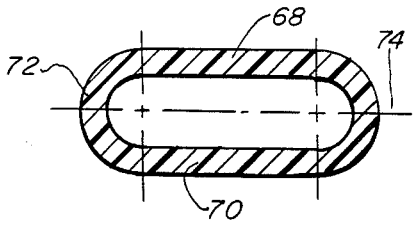
FIG. 3
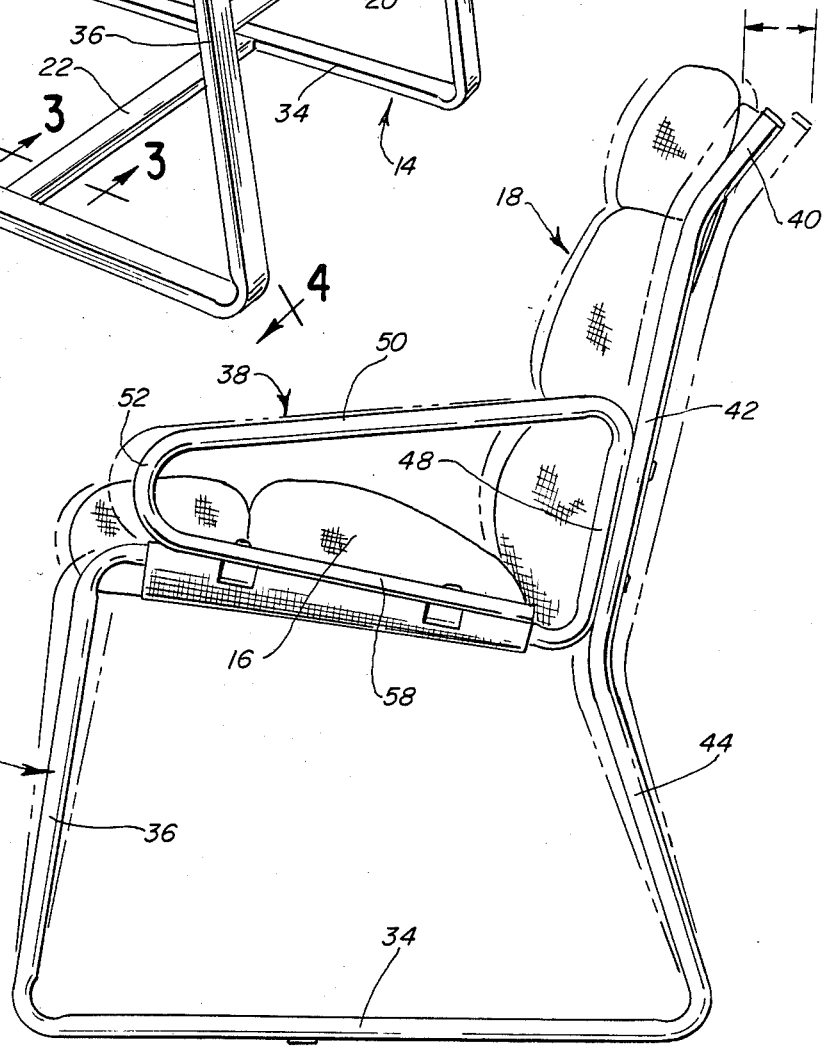
FIG. 2

FIG. 4
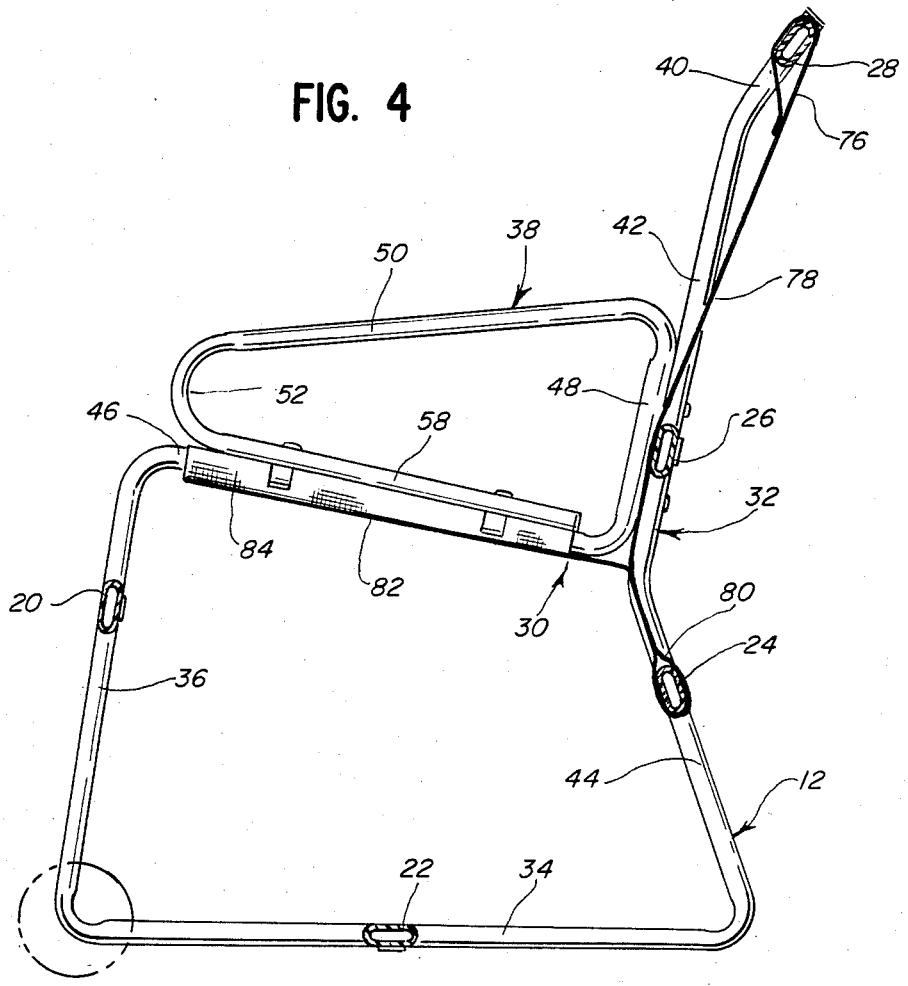
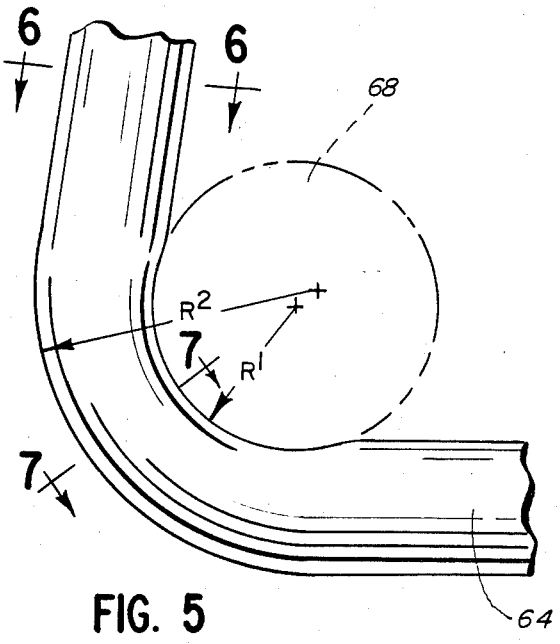
FIG. 5
FIG. 6
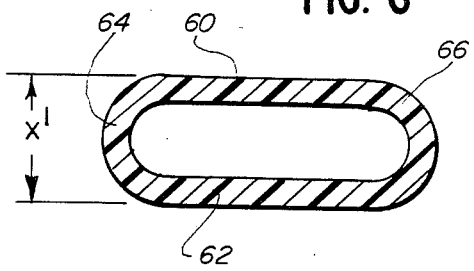
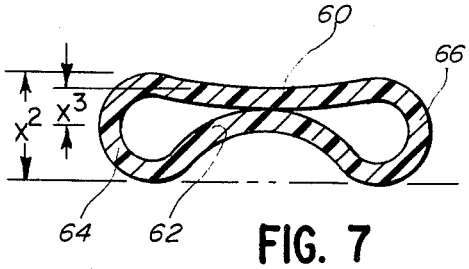
FIG. 7

FLEXIBLE CHAIR

BACKGROUND OF THE INVENTION

It is desirable that certain chairs have movement in selected portions. The typical chair with movement is a rocking chair. For many persons, a rocking chair has too much movement. It is desirable to have a limited amount of movement without the movement which accompanies a rocking chair. United States Letters Pat. No. 3,815,955, issued June 11, 1974, to Charles A. Gibilterra, entitled, "Chair Construction" discloses a chair which has movement in its seat and in its back. The movement of the seat is independant of the movement of the back. The Gibilterra construction allows movement in different directions for the seat and the back. It has been found that it is desirable to provide a chair construction wherein the allowed movement in the chair allows the seat and the back to move together as a unit. In order to provide a feeling of stability for one seated in the chair, the movement of the seat and back is limited to a back and forth movement. There is no lateral movement in the seat and back, thereby eliminating any feeling of tipping of the chair while a person is seated in the chair.

SUMMARY OF THE INVENTION

The present invention is directed to a chair construction having a movable back and seat wherein the back and the seat are connected and move together. The chair construction includes chair sides which are mirror images of each other. A seat and a back are positioned between the chair sides. Each of the chair sides is formed of a single elongated flexible plastic tubular member. Each of the chair sides includes a flexible back upright. The lower end of each back upright has an elongated horizontal floor rail formed integral therewith. Each horizontal floor rail has a flexible front upright formed integral therewith. The upper end of each front upright has an arm portion formed integral therewith. Each arm portion is fixed to the respective back upright to interconnect each back upright with each arm portion so that the seat and the back move together.

DESCRIPTION OF THE DRAWINGS

FIG. 1 is a perspective view of a chair embodying the present invention;

FIG. 2 is a side elevational view of the chair shown in FIG. 1, but showing a portion of the chair in phantom view at the limits of movement of the chair seat, back, and side;

FIG. 3 is a cross sectional view taken on line 3—3 of FIG. 1 showing the cross section of a portion of a cross member of the chair;

FIG. 4 is a cross sectional view taken on line 4—4 of FIG. 1;

FIG. 5 is an enlarged fragmentary view of a bent portion of a side of the chair of FIG. 1;

FIG. 6 is an enlarged cross sectional view taken on line 6—6 of FIG. 5; and FIG. 7 is an enlarged cross sectional view taken on line 7—7 of FIG. 5 showing a collapsed portion of the side of a bend.

DESCRIPTION OF THE PREFERRED EMBODIMENT

Referring now to the drawings and especially to FIG. 1, a chair embodying the present invention and generally indicated by numeral 10 is shown therein. The instant chair generally includes a pair of chair sides 12 and 14 with a seat 16 and a back 18 positioned between the sides.

Side 12 is a mirror image of side 14 and is connected to side 14 by cross members 20, 22, 24, 26, and 28. The sides are also connected to each other by a cushion support assembly 30. Each of the sides 12 and 14 is formed of a single piece of extruded flexible weather resistant polyvinyl chloride hollow tubing. The tubing is bent into the form of each of the side. In view of the fact that sides 12 and 14 are mirror images of each other, the same names and numbers will be used for identical and mirror image parts of the two sides.

Each side generally includes a flexible back upright 32 which has its lower end connected to an elongated horizontal floor rail 34. A flexible front upright 36 is formed integral with each horizontal floor rail. An arm portion 38 is formed integral with the upper end of each front upright. Each arm portion is fixed to its respective back upright 32.

Each back upright includes an upper back portion 40 with a main back portion 42 formed integral with the lower end of the upper back portion. A back leg portion 44 has its upper end formed integral with the main back portion and has its lower end formed integral with one end of horizontal rail 34. The back leg portion has its upper portion extending toward the front upright as may be seen in FIGS. 2 and 4. The front upright has having its upper portion extending toward the back upright and being above the juncture of the main back portion and the back leg as may be seen in FIGS. 2 and 4.

Arm portion 38 includes a seat bar 46 having one end formed integral with the upper end of front upright 36. Said seat bar has its other end formed integral with a back bar 48 which is parallel to main back portion 42 and is secured thereto by a pair of fasteners which are not shown herein. The specific construction of the fastener is disclosed in copending patent application Ser. No. 483,825, filed Apr. 11, 1983, and entitled, "Connector Construction". An arm rest 50 has one end formed integral with the upper end of back bar 48. A curved connector 52 has one end formed integral with arm rest 50 and the other end is formed integral with a lock bar 58 which is parallel to seat bar 46 and is secured to the seat bar by a pair of fasteners which are identical to the fasteneners connecting the back bar to the main back portion.

The cross section of the extruded tubing is shown in FIG. 6. The extruded tubing includes a pair of parallel faces 60 and 62. The faces are joined by semicicular connectors 64 and 66. The various portions of each of the sides is formed by heating the tubing, placing the heated tubing on a mandrel, and bending the tubing on the mandrel. A mandrel 68 is shown in dotted form in FIG. 5. As the tubing is bent around the mandrel, the face of the tubing which is adjacent to the mandrel is forced toward the opposite face until the cross section of the tubing at the bend assumes the attitude shown in FIG. 7. The collapse of the tubing when the tubing is warm and the subsequent cooling of the tubing results in the tubing being permanently formed in the bent attitude.

Each of the cross members, or cross bars 20, 22, 24, 26, and 28 has a cross section which is shown in FIG. 3. The cross section shown in FIG. 3 shows a pair of opposed parallel faces 68 and 70 connected by semicircular connectors 72 and 74. The cross section and the material of the tubing in the cross members is identical to the cross section and material of the tubing in sides 12 and 14. The ends of the cross bars are connected to the semicircular connectors of the sides utilizing a fastening arrangment disclosed in copending patent patent application Ser. No. 483,825, filed Apr. 11, 1983 entitled "Connector Construction."

The seat and the back are positioned on cushion support assembly 30. The cushion support assembly is a fabric material which includes a loop 76 supported by cross member 28. A back panel 78 is formed integral with loop 76 and extends down to a loop 80 which receives cross member 24. A seat panel 82 has one end fixed to back panel 78 and a pair of lateral edges 84 looped over each seat bar 46. Seat 16 and back 18 are made up of a cushion 86 which is mounted on the cushion support assembly.

The instant chair provides a flexible support for the seat and back while the seat and back are substantially rigidly connected relative to one another. When a person occupies the chair in a conventional manner resting upon seat 16 and engaging back 18, the person then may place his feet on a supporting surface for the chair and push back on the back. The arrangement of the uprights is such that the faces of the front uprights are in substantially the same plane across the width of the chair, and the faces of the back leg portion of the back uprights are in another plane. Thus, the front uprights and the back leg portion of the back uprights may be flexed backward substantially parallel to the floor rails of the sides. The resilience of the tubing then tends to urge the seat and back to move forward in a direction substantially parallel to the floor rails. The occupant then may pull forward on the supporting surface. It is to be noted that the front of the seat is higher than the rear of the seat which tends to keep the occupant on the seat even though the occupant pulls forward. The resilience of the front uprights and the back leg portions of the back uprights allows the seat and back to move foward past the stable center, but as the seat and back move forward, the resistance increases and the resilience of the tubing urges the seat and the back to move toward the back. The occupant, by a proper application of back and forth movement with the timing of the movement of the back and seat, may generate a rocking effect, thereby generating a pleasant sensation by moving back and forth with the seat and the back of the chair.

It may be appreciated that though the chair utilizes the flexing of the front uprights and the back leg portions of the back uprights, the seat and back are substantially rigid as to each other in view of the fact that the back bar of the arm portion is secured to the back upright and the lock bar is secured to the seat bar. This arrangement provides a comfortable feeling, since the back and arm rest along with the seat are generally fixed with relation to each other and the movement of the back and seat as a unit occurs from the legs relative to the floor but not the back of the occupant relative to the occupant's pelvis.

Although a specific embodiment of the herein disclosed invention as been shown in detail and described herein, it is readily apparent that those skilled in the art may make various modifications and changes without departing from the spirit and scope of the present invention. It is to be expressly understood that the instant invention is limited only by the appended claims.

What is claimed is:

1. In a chair construction having a pair of chair sides, a seat positioned between said chair sides, a back positioned between said sides, the improvement comprising; each of said chair sides being formed of a single elongated flexible member; each of said chair sides including; a flexible back upright, an elongated horizontal floor rail having one end formed integral with the lower end of the back upright, a flexible front upright having its lower end formed integral with the other end of the horizontal floor rail, and an arm portion formed integral with the upper end of the front upright, said arm portion being fixed to the back upright, each of said flexible members having substantially flat opposed parallel elongated faces, said faces defining a pair of planes extending across the width of the chair to allow the front and back uprights to flex thereby allowing the seat to move in a substantially horizontal plane in a direction substantially parallel to the horizontal floor rails of the sides.

2. In a chair construction as defined in claim 1, wherein each of said flexible members is formed of an extruded plastic material.

3. In a chair construction as defined in claim 1, wherein each of said elongated flexible members is an extruded polyvinyl chloride tube.

4. In a chair construction having a pair of chair sides, a seat positioned between said chair sides, a back positioned between said sides, the improvement comprising; each of said chair sides being formed of a single elongated flexible member; each of said chair sides including; a flexible back upright, an elongated horizontal floor rail having one end formed integral with the lower end of the back upright, a flexible front upright having its lower end formed integral with the other end of the horizontal floor rail, an arm portion formed integral with the upper end of the front upright, said arm portion being fixed to the back upright, each of said arm portions includes; a seat bar having one end formed integral with the upper end of the respective front upright, a back bar having one end formed integral with the other end of the seat bar, said back bar being secured to the respective back upright, an arm rest having one end formed integral with the other end of the back bar, and a lock bar having one end integrally connected to the other end of the arm rest, said lock bar being secured to the respective seat bar.

5. In a chair construction having a pair of chair sides, a seat positioned between said chair sides, a back positioned between said sides, the improvement comprising; each of said chair sides being formed of a single elongated flexible member; each of said chair sides including; a flexible back upright, an elongated horizontal floor rail having one end formed integral with the lower end of the back upright, a flexible front upright having its lower end formed integral with the other end of the horizontal floor rail, an arm portion formed integral with the upper end of the front upright, said arm portion being fixed to the back upright, each of said flexible members is tubular and has flat opposed substantially parallel faces, said faces defining planes extending across the width of the chair to allow the front and back uprights to flex and thereby allow the seat to move in a direction substantially parallel to the horizontal floor rail; and each arm portion including; a seat bar having one end formed integral with the upper end of the respective front upright, a back bar having one end formed integral with the other end of the seat bar, said back bar being secured to the respective back upright, an arm rest having one end formed integral with the other end of the back bar, and a lock bar having one end integrally connected to the other end of the arm rest, said lock bar being secured to the respective seat bar.

6. In a chair construction having a pair of chair sides, a seat positioned between said chair sides, a back positioned between said sides, the improvement comprising, each of said chair sides being formed of a single elongated flexible member; each of said chair sides including; a flexible back upright, an elongated horizontal floor rail having one end formed integral with the lower end of the back upright, a flexible front upright having its lower end formed integral with the other end of the horizontal floor rail, an arm portion formed integral with the upper end of the front upright, said arm portion being fixed to the back upright, each of said elongated flexible members is extruded plastic tubing, each of said arm portions is formed of the extruded plastic tubing having a uniform cross section throughout the arm portion, each of said arm portions including; a seat bar having one end formed integral with the upper end of the front upright, a back bar having one end formed integral with the other end of the seat bar, said back bar being secured to the respective back upright, an arm rest having one end formed integral with the other end of the back bar, and a lock bar having one end connected to the other end of the arm rest, said lock bar being secured to the respective seat bar.

7. In a chair construction having a pair of chair sides, a seat positioned between said chair sides, a back positioned between said sides, the improvement comprising; each of said chair sides being formed of a single elongated flexible member; each of said chair sides including; a flexible back upright, an elongated horizontal floor rail having one end formed integral with the lower end of the back upright, a flexible front upright having its lower end formed integral with the other end of the horizontal floor rail, an arm portion formed integral with the upper end of the front upright, said arm portion being fixed to the back upright, each of said flexible members is extruded hollow polyvinyl chloride tubing having spaced flat opposed parallel faces, said opposed parallel faces of one of the chair sides being in the same plane as the respective face in the other of the chair sides, said tubing allowing the front and back uprights to flex to allow the seat to move in a substantially horizontal plane in a direction substantially parallel to the horizontal floor rails; and each of said arm portions including; a seat bar having a flat face on its uppermost surface, said seat bar having one end formed integral with the upper end of the front upright, a back bar having a cross section identical to the cross section of the respective seat bar, said back bar having one end formed integral with the other end of the respective seat bar, said back bar being secured to the respective back upright with a flat face of the back bar being in contact with a flat face of the back upright, an arm rest having a cross section identical to the cross section of the respective back bar, said arm rest having a flat face on its uppermost surface, said arm rest having one end formed integral with the other end of the respective back bar, and a lock bar having one end integrally connected to the other end of the arm rest, and said back bar having a cross section identical to the cross section of the respective arm rest, said back bar having a flat face adjacent to the flat face of the respective seat bar and being secured to the seat bar.

8. In a chair construction as defined in claim 7 wherein said tubing of each of the sides is collapsed with the interior of flat faces abutting at the junction of each of the front uprights and the respective horizontal floor rail and at the junction of each of of the horizontal floor rails and the respective back upright.

9. A chair construction comprising, in combination, a pair of chair sides, said chair sides being mirror images of each other; a seat positioned between said chair sides, a back positioned between said chair sides; each of said chair sides being formed of a single elongated flexible weather-resistant polyvinyl chloride extruded tubing; each of the chair sides including; a back upright, each back upright including; an upper back portion, a main back portion having its upper end formed integral with the upper back portion, and a back leg portion having its upper end formed integral with the main back portion; said tubing having a cross section formed by a pair of opposed parallel flat faces over a substantial portion thereof; an elongated horizontal floor rail having one end formed integral with the lower end of the back leg portion; said floor rail having one of its faces forming the lowermost portion of the chair, a front upright having its lower end formed integral with the other end of the horizontal floor rail, said front upright having one of its faces facing the respective back upright, a seat bar having one end formed integral with the upper end of the front upright, said seat bar having one of its faces facing the horizontal floor rail, a back bar having one end formed integral with the other end of the seat bar, said back bar having one of its faces adjacent to the respective back upright, a fastener securing each back bar to the respective main back portion of the back upright, an arm rest having one of its faces facing upward from the arm rest, a lock bar having one end integrally connected to the other end of the arm rest, said lock bar having one of its faces facing the respective horizontal rail, and a second fastener securing each lock bar to the respective seat bar; and a front cross member having opposite ends secured to the leg portions of the sides, whereby application of a force in a direction substantially parallel to the floor rails causes the front and back uprights to flex and thereby allow movement of the seat in a direction which is substantially parallel to the floor rails.

10. A chair construction as defined in claim 9, wherein each back leg portion has its upper end sloping forward toward the respective front portion of the chair, and each front upright having its upper portion sloping rearward toward the respective back upright.

11. In a chair construction as defined in claim 9, wherein the extruded tubing of each of the flexible members is collapsed with opposed interior surfaces of the flat faces abutting at the junction of each back leg portion and the respective elongated floor rail and at the junction of each front upright and the respective elongated floor rail.

* * * * *